US009376899B2

(12) United States Patent
Wright et al.

(10) Patent No.: US 9,376,899 B2
(45) Date of Patent: Jun. 28, 2016

(54) RF ANTENNA ASSEMBLY WITH SPACER AND SHEATH AND RELATED METHODS

(71) Applicant: HARRIS CORPORATION, Melbourne, FL (US)

(72) Inventors: Brian Wright, Indialantic, FL (US); Murray Hann, Malabar, FL (US); Raymond Hewit, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 392 days.

(21) Appl. No.: 14/034,889

(22) Filed: Sep. 24, 2013

(65) Prior Publication Data

US 2015/0083387 A1 Mar. 26, 2015

(51) Int. Cl.

| | |
|---|---|
| ***E21B 43/24*** | (2006.01) |
| ***E21B 47/12*** | (2012.01) |
| ***H01Q 1/04*** | (2006.01) |
| ***H01Q 1/44*** | (2006.01) |

(52) U.S. Cl.

CPC ..... *E21B 43/2401* (2013.01); *E21B 47/122* (2013.01); *H01Q 1/04* (2013.01); *H01Q 1/44* (2013.01); *Y10T 29/49016* (2015.01)

(58) Field of Classification Search

CPC .. E21B 43/2401; E21B 47/122; F16L 39/005; H01P 11/00; H01P 3/06; H01Q 9/16; H01Q 1/04; H01Q 1/44

See application file for complete search history.

(56) References Cited

U.S. PATENT DOCUMENTS

| | | | | |
|---|---|---|---|---|
| 2,187,584 | A * | 1/1940 | Gothe | H01B 11/1873 174/28 |
| 2,351,520 | A * | 6/1944 | Katzin | H01B 11/186 174/27 |
| 2,795,397 | A | 6/1957 | Hull et al. | |
| 3,496,496 | A * | 2/1970 | Fiebel | H01R 24/40 333/260 |
| 3,716,652 | A | 2/1973 | Lusk et al. | |
| 3,813,479 | A | 5/1974 | Olivero | |
| 4,012,092 | A | 3/1977 | Godbey | |
| 4,207,574 | A | 6/1980 | Toia | |

(Continued)

FOREIGN PATENT DOCUMENTS

| | | |
|---|---|---|
| WO | 2013192124 | 12/2013 |
| WO | 2014160137 | 10/2014 |

OTHER PUBLICATIONS

"Drill Faster, Farther, Deeper," Aluminum Drill Pipe, Inc. brochure (Addendum Feb. 28, 2008), pp. 1-11.

(Continued)

*Primary Examiner* — Jennifer H Gay

(74) *Attorney, Agent, or Firm* — Allen, Dyer, Doppelt, Milbrath & Gilchrist, P.A.

(57) ABSTRACT

An RF antenna assembly is positioned within a wellbore in a subterranean formation for hydrocarbon resource recovery. The RF antenna assembly includes first and second tubular conductors to be positioned within the wellbore, and having adjacent joined together ends, and first and second RF transmission line segments extending within the first and second tubular conductors and having adjacent joined together ends aligned with the joined together adjacent ends of the first and second tubular conductors. The RF antenna assembly includes a tubular sheath surrounding the first RF transmission line segment and having an outer surface, and a spacer received on the outer surface of the tubular sheath and extending between the tubular sheath and adjacent portions of the first tubular conductor.

26 Claims, 10 Drawing Sheets

(56) References Cited

U.S. PATENT DOCUMENTS 4,359,743 A 11/1982 DeSantis
4,498,086 A 2/1985 Sandler
4,543,548 A * 9/1985 Seal ..... H01P 1/30 138/120
4,583,589 A 4/1986 Kasevich
4,647,941 A 3/1987 Myer
4,660,910 A * 4/1987 Sharp ..... E21B 17/028 439/194
5,065,819 A 11/1991 Kasevich
5,068,672 A 11/1991 Onnigian et al.
5,109,927 A 5/1992 Supernaw et al.
5,455,548 A * 10/1995 Grandchamp ..... H01P 1/045 174/28
5,568,161 A 10/1996 Fulmer, Sr.
5,617,105 A 4/1997 Tsunekawa et al.
5,751,895 A 5/1998 Bridges
6,154,179 A 11/2000 Kohno
6,189,611 B1 2/2001 Kasevich
6,415,869 B1 7/2002 Smith
6,681,861 B2 1/2004 Davidson et al.
6,712,644 B1 * 3/2004 DeCormier ..... H01P 1/045 174/28
6,720,934 B1 4/2004 Price et al.
6,771,227 B2 8/2004 Tsai et al.
7,055,599 B2 * 6/2006 Kasevich ..... E21B 43/006 166/248
7,239,286 B1 7/2007 Miller et al.
7,404,725 B2 * 7/2008 Hall ..... E21B 17/028 439/194
7,441,597 B2 10/2008 Kasevich
7,488,194 B2 2/2009 Hall et al.
7,649,475 B2 * 1/2010 Hall ..... E21B 17/028 166/380
7,891,421 B2 2/2011 Kasevich
7,962,288 B2 6/2011 Gleitman
8,003,014 B2 8/2011 Breay et al.
8,128,786 B2 3/2012 White et al.
8,556,656 B2 * 10/2013 Thomas ..... H01R 9/0521 439/584
8,847,711 B2 * 9/2014 Wright ..... E21B 43/2401 166/248
8,969,722 B2 * 3/2015 Bonn ..... H01B 11/1856 174/102 P
9,016,367 B2 * 4/2015 Wright ..... E21B 43/2401 166/242.3
9,157,305 B2 * 10/2015 Dittmer ..... E21B 43/2401
9,181,787 B2 * 11/2015 Wright ..... E21B 43/2401
9,194,221 B2 * 11/2015 Parsche ..... H01Q 9/16
2002/0093431 A1 7/2002 Zierolf
2002/0189817 A1 12/2002 Davidson et al.
2003/0032339 A1 2/2003 Bell et al.
2004/0074638 A1 * 4/2004 Kasevich ..... E21B 43/006 166/248
2005/0199386 A1 9/2005 Kinzer
2005/0200498 A1 9/2005 Gleitman
2007/0187089 A1 8/2007 Bridges
2008/0003894 A1 * 1/2008 Hall ..... E21B 17/028 439/824
2008/0166917 A1 * 7/2008 Hall ..... E21B 17/028 439/583
2009/0272576 A1 * 11/2009 Medina ..... H02G 3/30 174/72 A
2010/0078163 A1 4/2010 Banerjee et al.
2010/0294488 A1 11/2010 Wheeler et al.
2010/0294489 A1 11/2010 Dreher, Jr. et al.
2012/0012219 A1 1/2012 Breay et al.
2012/0176138 A1 7/2012 Prammer
2012/0325516 A1 * 12/2012 Bonn ..... H01B 11/1873 174/113 R
2013/0048278 A1 2/2013 Parsche et al.
2013/0180729 A1 7/2013 Wright et al.
2013/0334205 A1 * 12/2013 Wright ..... E21B 43/2406 219/541
2014/0020908 A1 * 1/2014 Wright ..... E21B 43/2401 166/378
2014/0041890 A1 * 2/2014 Wright ..... E21B 17/18 174/19
2014/0043115 A1 * 2/2014 Wright ..... E21B 43/2401 333/243
2014/0224472 A1 * 8/2014 Parsche ..... H01Q 9/16 166/60
2014/0262222 A1 * 9/2014 Wright ..... E21B 36/04 166/248
2014/0262223 A1 * 9/2014 Wright ..... E21B 36/04 166/248
2014/0262224 A1 * 9/2014 Ayers ..... E21B 43/2401 166/248
2015/0070112 A1 * 3/2015 Wright ..... E21B 36/04 333/243
2015/0083387 A1 * 3/2015 Wright ..... E21B 47/122 166/57

OTHER PUBLICATIONS

Wright et al., U.S. Appl. No. 14/024,875, filed Sep. 12, 2013.

* cited by examiner

RF ANTENNA ASSEMBLY WITH SPACER AND SHEATH AND RELATED METHODS

FIELD OF THE INVENTION

The present invention relates to the field of hydrocarbon resource processing, and, more particularly, to an antenna assembly isolator and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale. While RF heating may address some of these shortcomings, further improvements to RF heating may be desirable. For example, it may be relatively difficult to install or integrate RF heating equipment into existing wells.

SUMMARY OF THE INVENTION

In view of the foregoing background, it is therefore an object of the present invention to provide an RF antenna assembly that is physically robust and that can be readily installed in a wellbore.

This and other objects, features, and advantages in accordance with the present invention are provided by an RF antenna assembly configured to be positioned within a wellbore in a subterranean formation for hydrocarbon resource recovery. The RF antenna assembly comprises first and second tubular conductors to be positioned within the wellbore, and having adjacent joined together ends, and first and second RF transmission line segments extending within the first and second tubular conductors and having adjacent joined together ends aligned with the joined together adjacent ends of the first and second tubular conductors. The RF antenna assembly includes a tubular sheath (e.g. dielectric tubular sheath) surrounding the first RF transmission line segment and having an outer surface, and a spacer (e.g. dielectric spacer) received on the outer surface of the tubular sheath and extending between the tubular sheath and adjacent portions of the first tubular conductor. Advantageously, the RF antenna assembly may provide a robust support structure for the RF transmission line segments, and may be readily installed in a wellbore.

Another aspect is directed to a method of making an RF antenna assembly to be positioned within a wellbore in a subterranean formation for hydrocarbon resource recovery. The method comprises positioning a first tubular conductor and a first RF transmission line segment within the wellbore, the first RF transmission line segment being within the first tubular conductor and having an end extending outward from the wellbore and past an end of the first tubular conductor, and engaging a spacer onto an outer surface of a tubular sheath surrounding the first RF transmission line segment so that the spacer extends between the tubular sheath and adjacent portions of the first tubular conductor. The method includes threadingly engaging an end of a second RF transmission line segment, exposed from an end of a second tubular conductor, onto the end of the first RF transmission line segment extending past the end of the first tubular conductor, and sliding the second tubular conductor down the second RF transmission line segment and threadingly engaging the second tubular conductor onto the first tubular conductor.

DETAILED DESCRIPTION OF THE PREFERRED EMBODIMENTS

Figure 1:
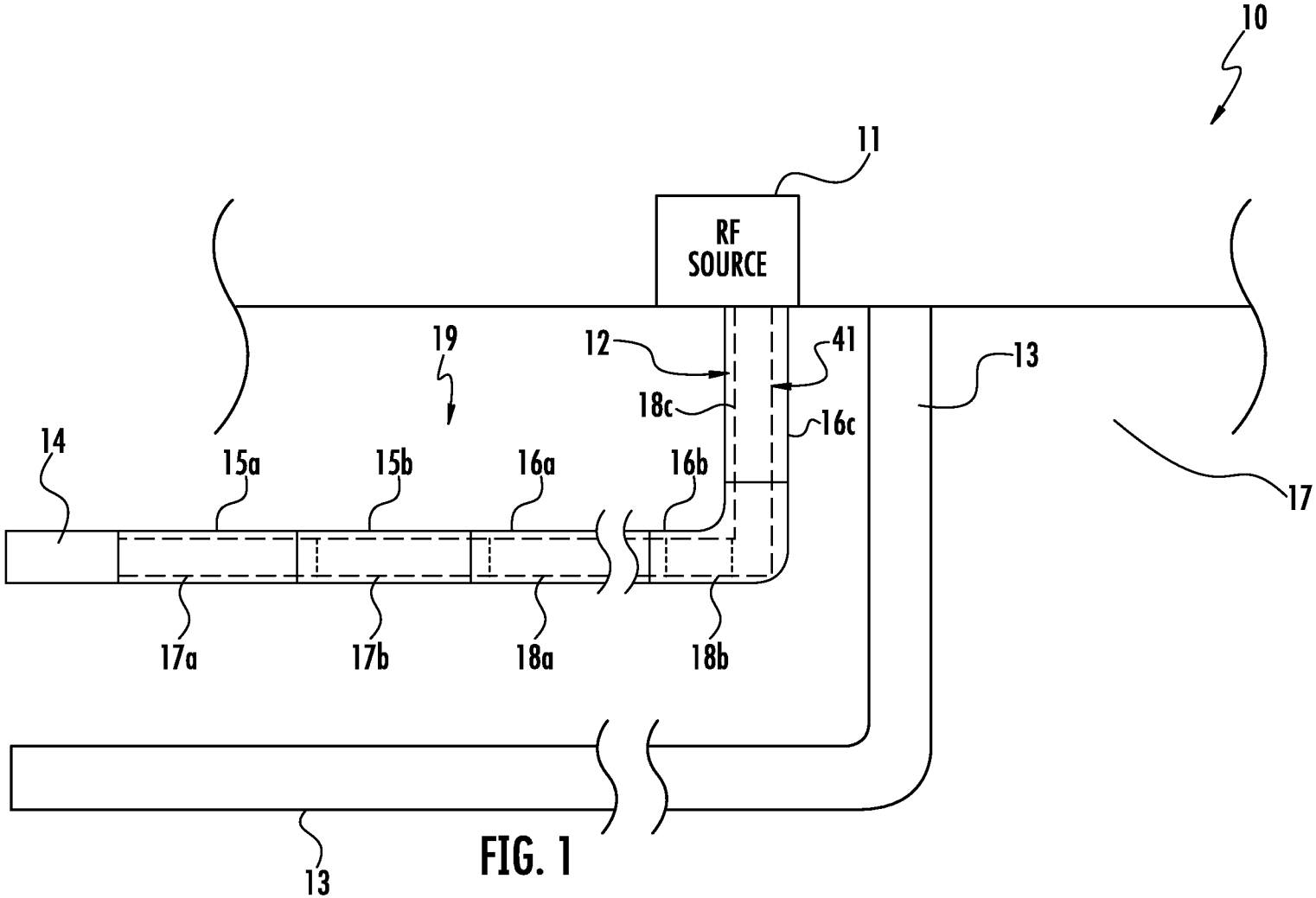
FIG. 1 is a schematic diagram of a hydrocarbon recovery system in a subterranean formation, according to the present invention.
Figure 2:
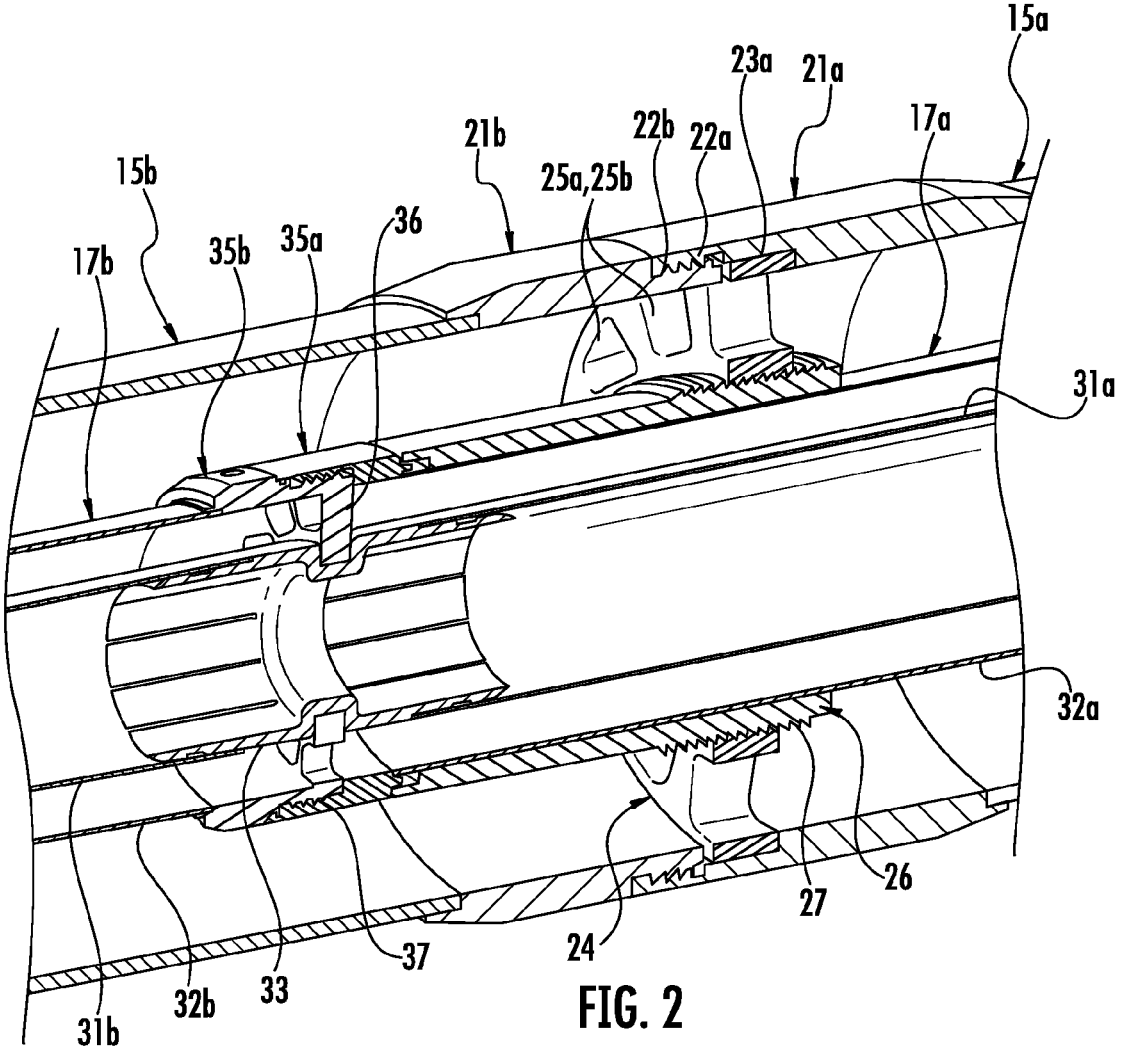
FIG. 2 is a partial fragmentary view of the adjacent joined together ends of the first and second tubular conductors and the first and second RF transmission line segments of an RF antenna assembly from FIG. 1.
Figure 3A:
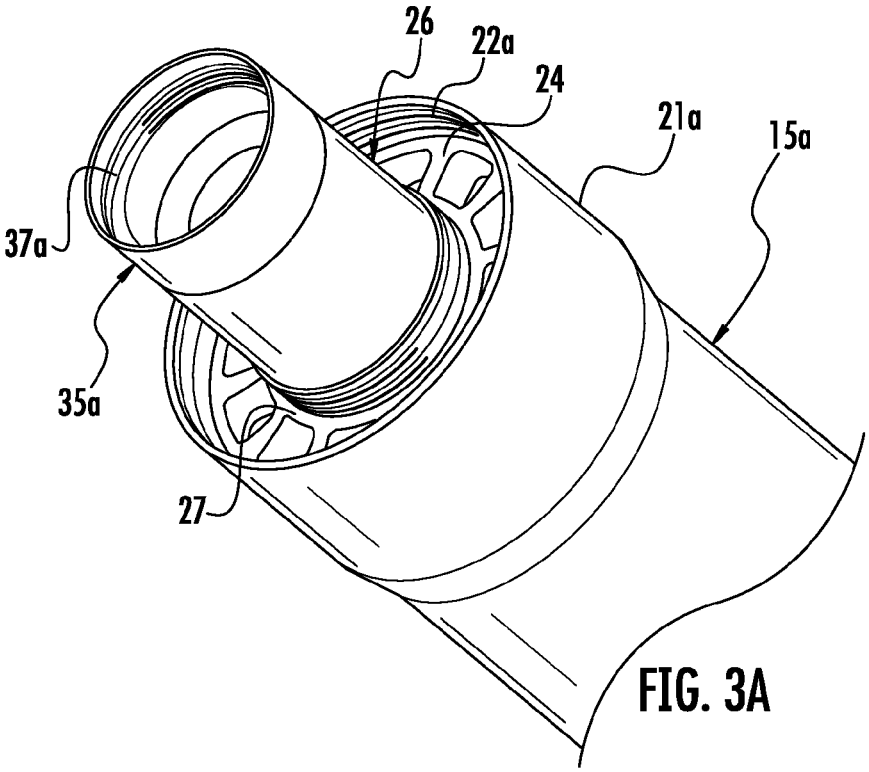
FIG. 3A is a perspective view of the first tubular conductor and the first RF transmission line segment of the RF antenna assembly of FIG. 2.
Figure 3B:
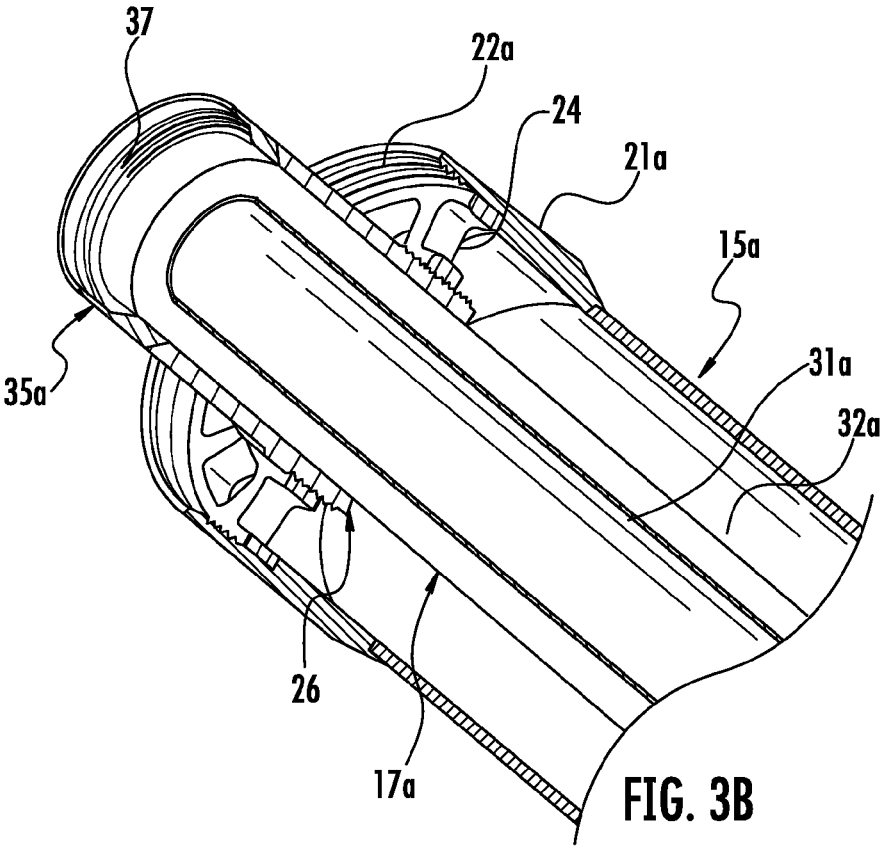
FIG. 3B is a partial fragmentary view of the first tubular conductor and the first RF transmission line segment of the RF antenna assembly of FIG. 2.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1-3B, a hydrocarbon recovery system 10 according to the present invention is now described. The hydrocarbon recovery system 10 includes an injector well 12, and a producer well 13 configured to be positioned within respective wellbores in a subterranean formation 17 for hydrocarbon recovery. The injector well 12 includes an RF antenna assembly 19 configured to be positioned within the subterranean formation 17. The hydrocarbon recovery system 10 includes an RF source 11 for driving the antenna assembly 19 to generate RF heating of the subterranean formation 17 adjacent the injector well 12.

The antenna assembly 19 comprises an antenna element 14 (e.g. tubular) at a distal end thereof, for example, a center fed dipole antenna, positioned within one of the wellbores, and a RF transmission line 41 positioned within the injector well 12 and extending from the RF source 11 to the antenna element. The RF antenna assembly 19 comprises a plurality of tubular conductors 15*a*-16*c* positioned within the wellbore. The plurality of tubular conductors 15*a*-16*b* comprises first 15*a* and second 15*b* tubular conductors having adjacent joined together ends 21*a*-21*b*.

The RF antenna assembly 19 comprises the RF transmission line 41, which includes a plurality of RF transmission line segments 17*a*-18*c*. The plurality of RF transmission line segments 17*a*-18*c* includes first and second RF transmission line segments 17*a*-17*b* extending within the first and second tubular conductors 15*a*-15*b* and having adjacent joined together ends 35*a*-35*b* aligned with the joined together adjacent ends 21*a*-21*b* of the first and second tubular conductors. In particular, the adjacent joined together ends 35*a*-35*b* of the first and second RF transmission line segments 17*a*-17*b* are aligned to be offset from the joined together adjacent ends 21*a*-21*b* of the first and second tubular conductors 15*a*-15*b*. Advantageously, this offset is part of the design to allow for assembly of the first and second RF transmission line segments 17*a*-17*b* (i.e. inner tubular string) before the outer sleeve is installed. The offset allows for an area on the inner tubular for tools for torque to be applied, allowing easier assembly.

The adjacent joined together ends 35*a*-35*b* of the first and second RF transmission line segments 17*a*-17*b* comprise a threaded surface 37 for mechanical coupling the ends together. Also, each adjacent joined together end 35*a*-35*b* of the first and second RF transmission line segments 17*a*-17*b* comprises a plurality of tool receiving recesses for aiding assembly (e.g. using a torque wrench).

The RF antenna assembly 19 includes a tubular sheath 26 surrounding the first RF transmission line segment 17*a* and having a threaded outer surface 27. For example, the tubular sheath 26 may comprise a dielectric tubular sheath. In other embodiments, where high voltage (HV) standoff is not an issue, the tubular sheath 26 may comprises a metallic material (e.g. steel, aluminum).

The RF antenna assembly 19 includes a spacer 24 (centralizer). The spacer 24 centralizes the first and second RF transmission line segments 17*a*-17*b* within the first and second tubular conductors 15*a*-15*b*. The spacer 24 comprises an inner radial threaded surface for threadingly engaging the threaded outer surface 27 of the tubular sheath 26. The spacer 24 extends between the tubular sheath 26 and adjacent portions of the first tubular conductor 15*a*. Advantageously, the spacer 24 and the sheath 26 cooperate to permit coefficient of thermal expansion (CTE) growth of the RF transmission line 41 during hydrocarbon recovery (due to heating and pressure). Moreover, the spacer 24 controls the spacing between the RF transmission line 41 and the first and second tubular conductors 15*a*-15*b*, thereby reducing the chances of HV arching.

As will be appreciated, during hydrocarbon recovery operations, fluids (e.g. coolant, gases, hydrocarbon solvent) will be exchanged through the injector well 12. The first and second tubular conductors 15*a*-15*b* and the RF transmission line 41 are spaced apart to define a first fluid passageway. In the illustrated embodiment, the spacer 14 includes a plurality of spaced apart passageways 25*a*-25*b* therein for permitting fluid flow through the first fluid passageway.

Additionally, each of the first and second RF transmission line segments 17*a*-17*b* comprises an inner conductor 31*a*-31*b* and an outer conductor 32*a*-32*b* surrounding the inner conductor. The inner and outer conductors 31*a*-32*b* are also spaced apart to define a second fluid passageway. Also, in the illustrated embodiment, the inner conductors 31*a*-31*b* are tubular and also define a third fluid passageway.

The RF transmission line 41 illustratively includes an inner conductor coupler 33 for coupling together adjacent inner conductors 31*a*-31*b* from the first and second RF transmission line segments 17*a*-17*b*. The RF transmission line 41 illustratively includes a spacer 36 supporting the outer conductors 32*a*-32*b* and comprising a plurality of passageways for permitting flow through the second fluid passageway. The spacer 41 may comprise a dielectric material.

The first tubular conductor 15*a* illustratively includes a recess at an end 21*a* thereof for defining a shoulder 23*a* receiving the spacer 24. The first tubular conductor 15*a* illustratively includes a threaded surface 22*a* on the end 21*a* thereof. Also, the second tubular conductor 15*b* illustratively includes a threaded surface 22*b* on the end 21*b* thereof for engaging the threaded surface 22*a* of the first tubular conductor 15*a*. The second tubular conductor 15*b* threadingly engages the end 21*a* of the first tubular conductor 15*a* and urges the spacer 24 into the shoulder 23*a*. During operation of the RF antenna assembly 19, the spacer 24 distributes the weight and load from the vertical weight of the RF transmission line 41, which can be significant, onto the more structurally strong outer tubular conductors 15*a*-15*b* (i.e. the transducer). This may reduce the risk of the RF transmission line 41 buckling under its own weight.

Additionally, as depicted in FIG. 1, the tubular outer shell of the injector well 12 comprises several tubular conductors 15*a*-16*c*. Each joined together end of the conductors 15*a*-16*b* comprises a spacer 24, thereby distributing the vertical load of the RF transmission line 41 at longitudinally spaced apart joints.

Figure 4:
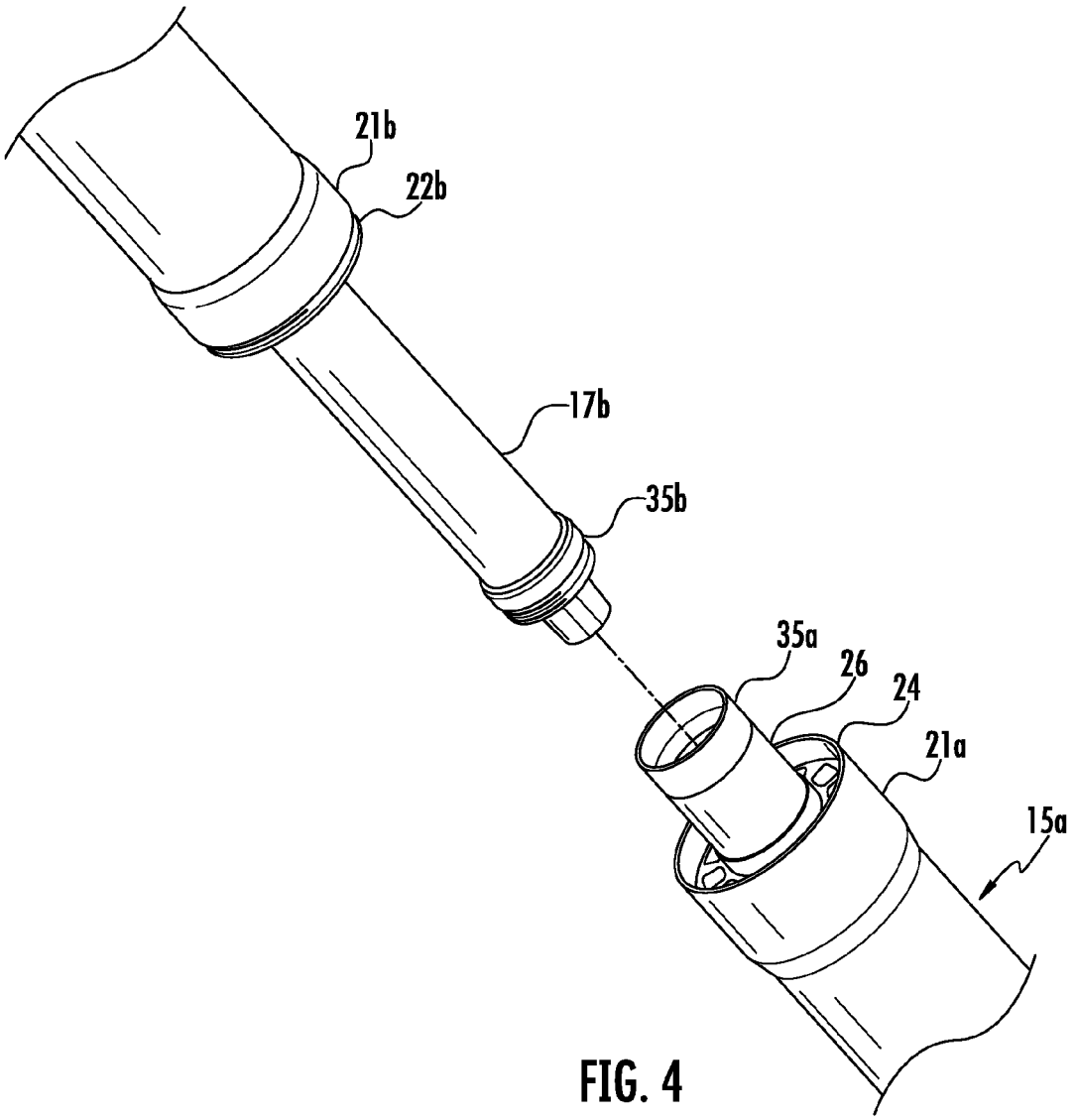
FIGS. 4-5 are perspective views of the adjacent joined together ends of the first and second tubular conductors and the first and second RF transmission line segments of the RF antenna assembly of FIG. 2 during assembly.
Figure 5:
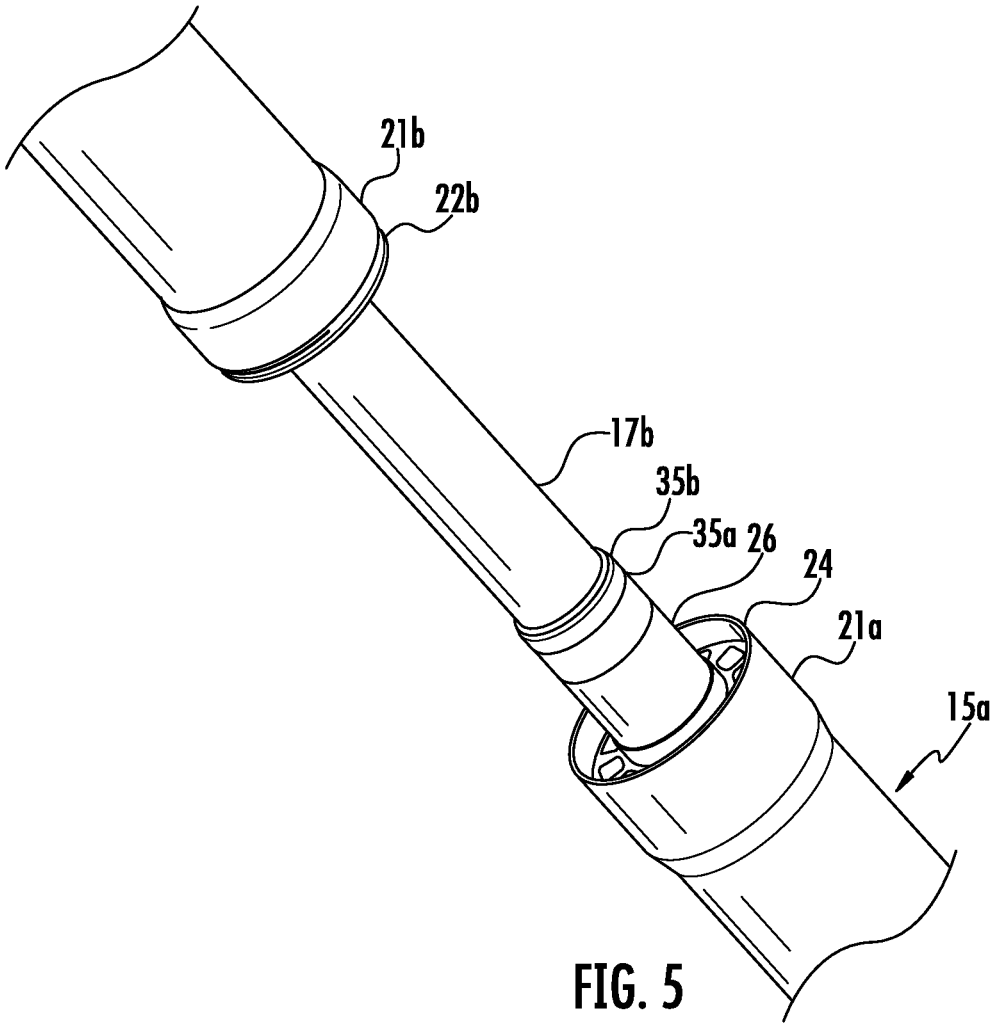
Figure 6:
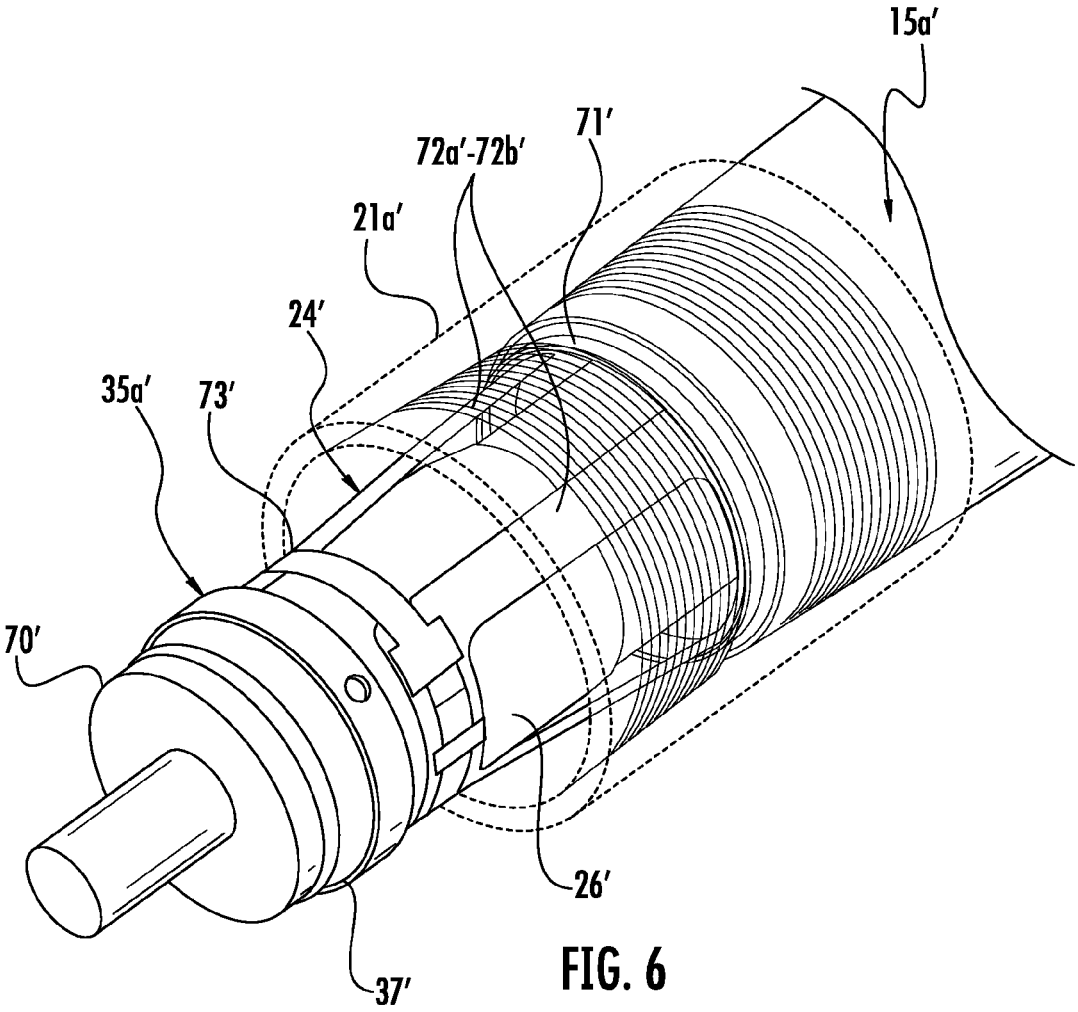
FIG. 6 is a perspective view of the first tubular conductor and the first RF transmission line segment of the RF antenna assembly, according to another embodiment of the present invention.
Figure 7:
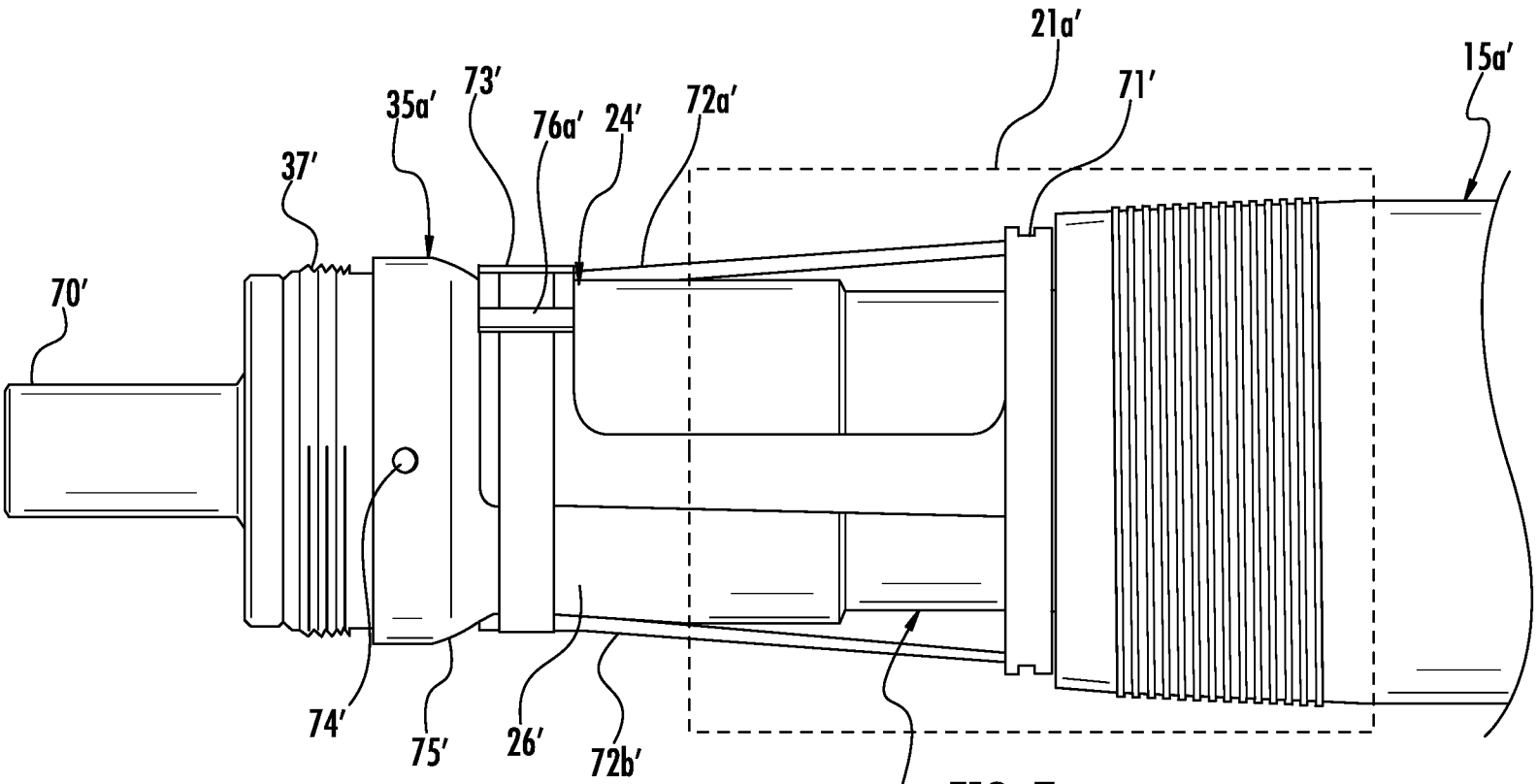
FIG. 7 is a side view of the first tubular conductor and the first RF transmission line segment of the RF antenna assembly of FIG. 6.

Referring now additionally to FIG. 4-5, the RF antenna assembly 19 is assembled a segment at a time on the drilling rig (not shown). The first and second tubular conductors 15*a*-15*b* are assembled using the floating RF transmission line 41 components as a guide. As perhaps best seen in FIGS. 3A-3B, the first RF transmission line segment 17*a* extends outwardly from an adjacent end 21*a* of the first tubular conductor 15*a*. The tubular sheath 26 longitudinally extends from the spacer 24 to the adjacent joined together ends 35*a*-35*b* of the first and second RF transmission line segments 17*a*-17*b*. The end 35*b* of the second transmission line segment 17*b* is threaded on the first transmission line segment 17*a*. After the first and second transmission line segments 17*a*-17*b* have been properly torqued onto each other, the second tubular conductor 15*b* slides over the coupled first and second transmission line segments 17*a*-17*b* and is similarly threaded onto the first tubular conductor 15*a*.

The RF antenna assembly 19 disclosed herein may provide an approach to potential issues during assembly of a down hole, subterranean antenna structure. In particular, such assembly may require supporting the RF transmission line inside of the antenna and balun sections (or choke sections), i.e. common mode current mitigation sections, which can be difficult. The RF transmission line may be filled with oil, and be capable of sustaining a pressure of about 300 psi. Thus, the RF transmission line is typically quite heavy. Moreover, the RF antenna assembly may be subjected to geometry (bends in the bore, at the heel for typical SAGD applications), which must be transferred to the interior RF transmission line (i.e. must also bend the RF transmission line, while maintaining HV standoff distances).

Advantageously, the RF antenna assembly 19 allows operators to build an antenna assembly for high power RF oil recovery, specifically providing an apparatus that transfers loads from the central coaxial transmission line 41 assembly to the exterior antenna. The RF antenna assembly 19 also: allows for transfer of very high vertical loads from the RF coaxial transmission line 41 to the antenna structure; allows the RF coaxial transmission line to be a lighter weight construction; centralizes (centering) the RF coaxial transmission line inside the antenna cavity, maintaining HV isolation; and allows for transfer of loads from the antenna to the RF coaxial transmission line, resulting from imposed geometry (i.e. a bend in the bore).

Also, the RF antenna assembly 19 may: be constructed of RF isolative materials, so that it can be utilized in antenna zones that require HV standoff; be constructed of conductive materials, in areas of the antenna that do not require HV standoff; be capable of being installed on a typical oil drill rig; be capable of being adjustable to absorb a high level of build tolerances; be capable of being load adjustable, so that a preset tension can be applied to the coax using torque; and be capable of being trapped (retained) mechanically in a cavity between joints of antenna structure.

Another aspect is directed to a method of making an RF antenna assembly 19 to be positioned within a wellbore in a subterranean formation 17 for hydrocarbon resource recovery. The method comprises positioning first and second tubular conductors 15*a*-15*b* within the wellbore, and having adjacent joined together ends 21*a*-21*b*, and positioning first and second RF transmission line segments 17*a*-17*b* to extend within the first and second tubular conductors and having adjacent joined together ends 35*a*-35*b* aligned with the joined together adjacent ends of the first and second tubular conductors. The method includes positioning a tubular sheath 26 to surround the first RF transmission line segment 17*a*, the tubular sheath having a threaded outer surface 27, and positioning a spacer 24 to be threadingly received on the threaded outer surface of the tubular sheath and extend between the tubular sheath and adjacent portions of the first tubular conductor 15*a*.

Yet another aspect is directed to a method of making an RF antenna assembly 19 to be positioned within a wellbore in a subterranean formation 17 for hydrocarbon resource recovery. This method comprises positioning a first tubular conductor 15*a* and a first RF transmission line segment 17*a* within the wellbore. The first RF transmission line segment 17*a* is within the first tubular conductor 15*a* and has an end 35*a* extending outward from the wellbore and past an end 21*a* of the first tubular conductor. The method also includes threadingly engaging a spacer 24 onto a threaded outer surface 27 of a tubular sheath 26 surrounding the first RF transmission line segment 17*a* so that the spacer extends between the tubular sheath and adjacent portions of the first tubular conductor 15*a*. The method includes threadingly engaging an end 35*b* of a second RF transmission line segment 17*b*, exposed from an end 21*b* of a second tubular conductor 15*b*, onto the end 35*a* of the first RF transmission line segment 17*a* extending past the end 21*a* of the first tubular conductor 15*a*. The method also includes sliding the second tubular conductor 15*b* down the second RF transmission line segment 17*b* and threadingly engaging the second tubular conductor onto the first tubular conductor 15*a*.

Referring now additionally to FIGS. 6-9B, another embodiment of the RF antenna assembly 19' is now described. In this embodiment of the RF antenna assembly 19', those elements already discussed above with respect to FIGS. 1-5 are given prime notation and most require no further discussion herein. This embodiment differs from the previous embodiment in that this RF antenna assembly 19' has a spacer (i.e. a hanger) 24' comprising a ring portion 71', and a plurality of arms 72*a*'-72*b*' extending longitudinally along the tubular sheath 26' from the ring portion and towards the end 35*a*' of the first RF transmission line segment 17*a*'. The ring portion 71' illustratively includes a plurality of circumferential keys. This spacer 24' also differently comprises at least one metal material, such as steel.

The spacer 24' illustratively includes a retention strap 73' coupling the plurality of arms 72*a*'-72*b*' onto the outer surface of the tubular sheath 26', and a plurality of retention strap rings 76*a*'-76*b*' for fixing the retention strap to the arms. In particular, the retention strap 73' applies radially inward force to retain the arms 72*a*'-72*b*' onto the tubular sheath 26'. The first tubular conductor 15*a*' has a plurality of keyed recesses at an end thereof for receiving the circumferential keys of the ring portion 71'. Also, in this embodiment, the tubular sheath 26' is integral with the end 35*a*' of the first RF transmission line segment 17*a*' and comprises a threaded surface 37' for receiving the opposing end 35*b*' of the second RF transmission line segment 17*b*'. The tubular sheath 26' also includes a plurality of tool receiving recesses 74' for applying torque during assembly of the RF transmission line segments 17*a*'-17*b*', and a textured outer surface for aiding in the frictional coupling to the arms 72*a*'-72*b*' of the spacer 24'. Positively, during use, the arms 72*a*'-72*b*' may tolerate radial expansion from the first RF transmission line segment 17*a'*.

Figure 8B:
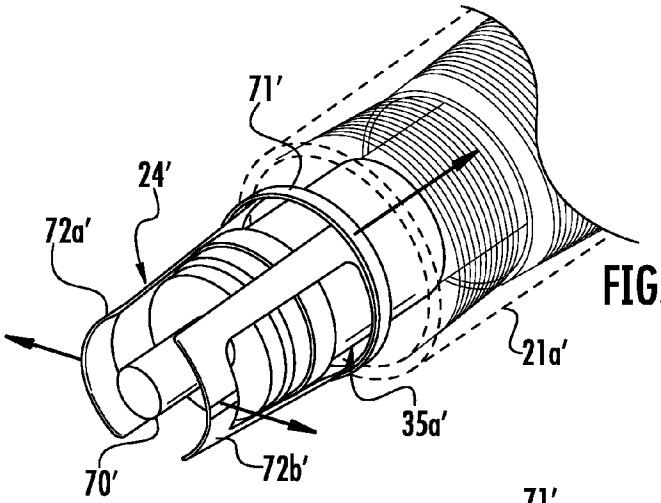
FIGS. 8A-8E are perspective views of the ends of the first tubular conductor and the first RF transmission line segment of the RF antenna assembly of FIG. 6 during assembly of the spacer.
Figure 8A:
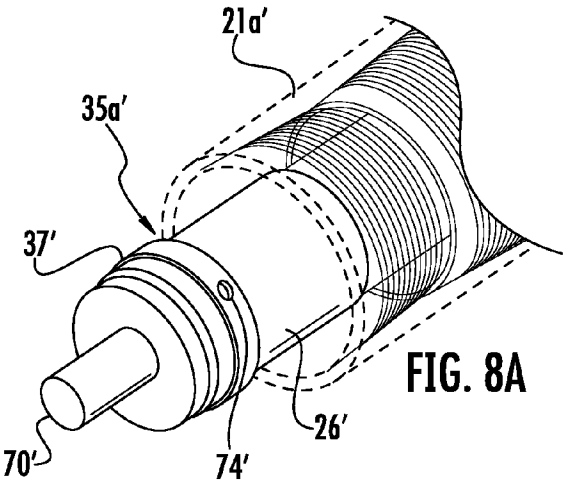
Figure 8D:
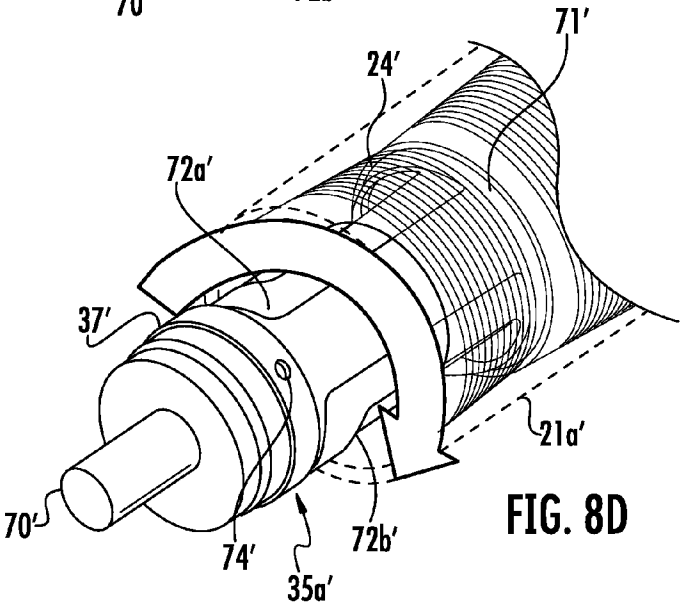
Figure 8C:
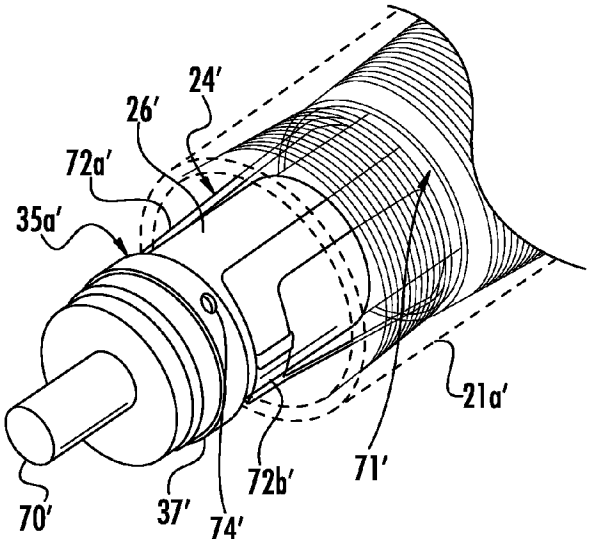
Figure 8E:
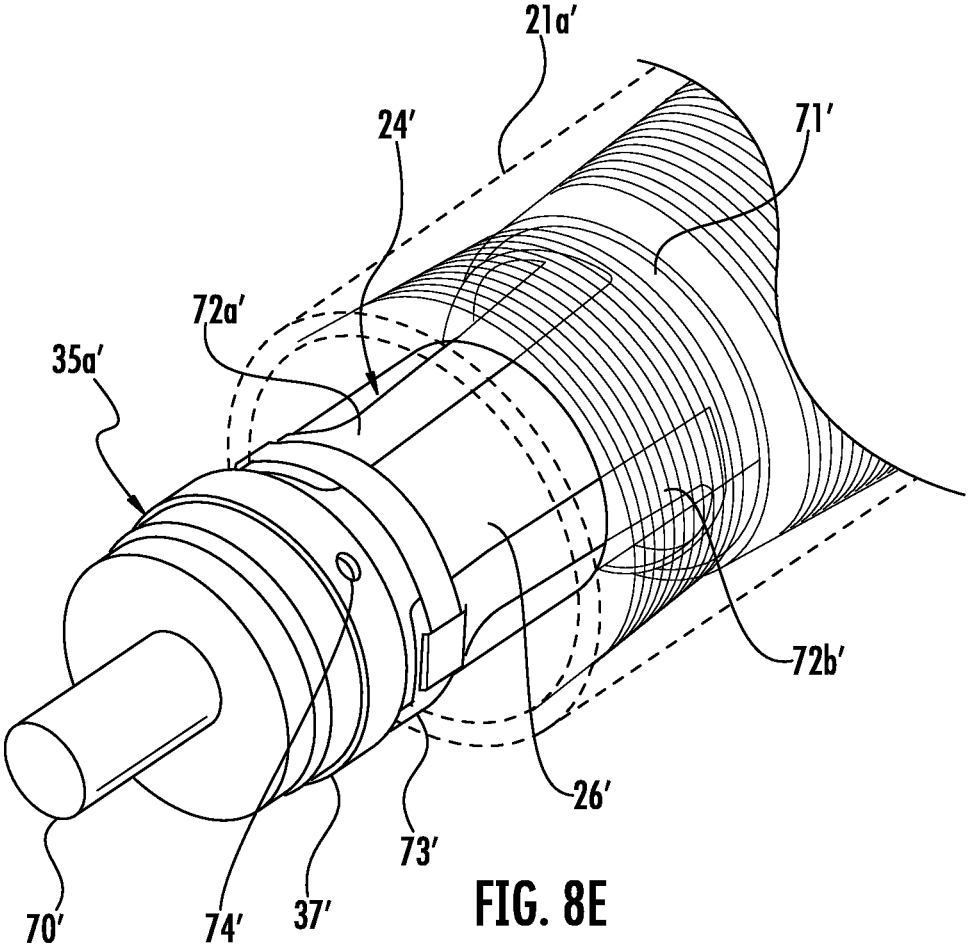
Figures 9A, 9B:
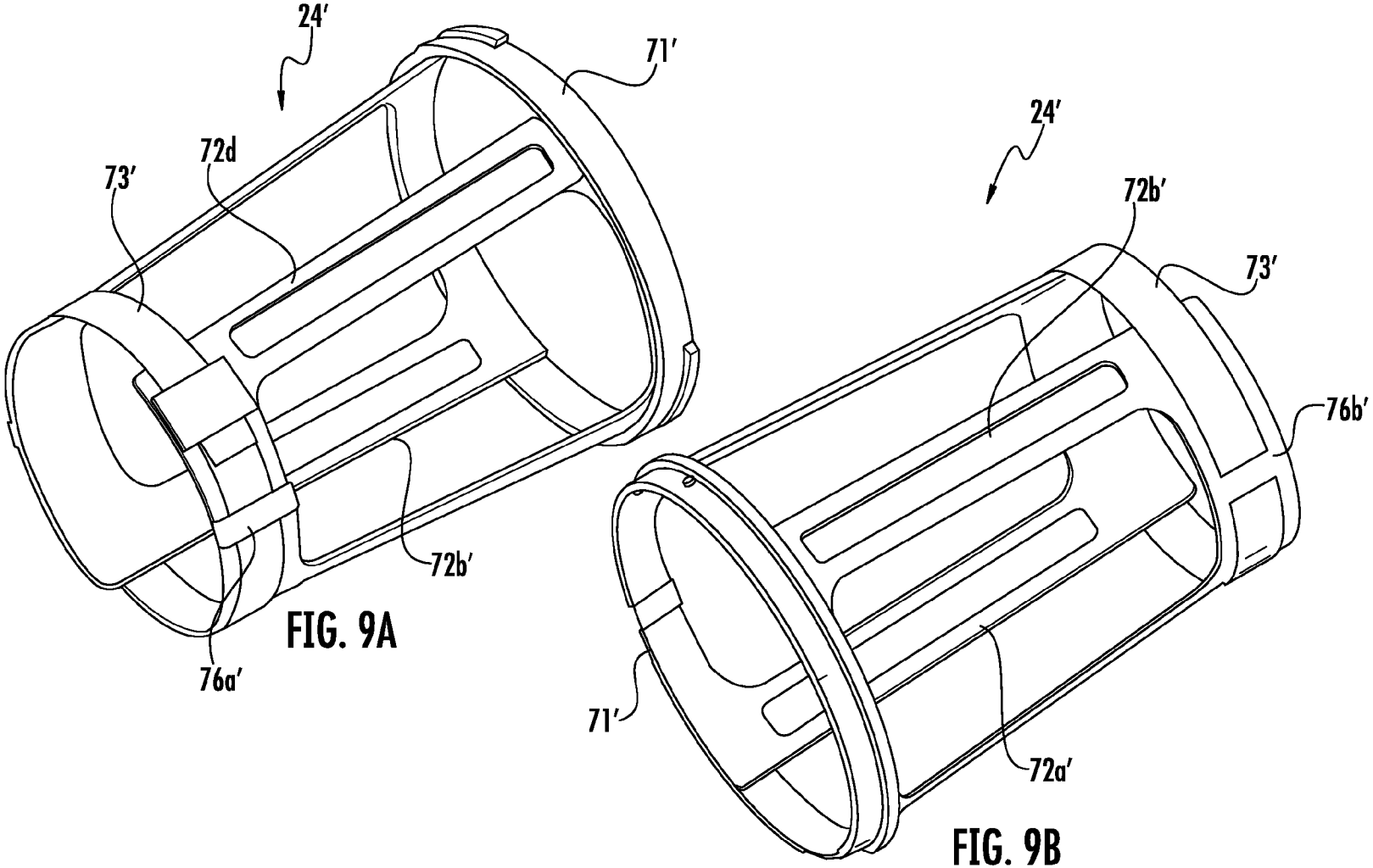
FIGS. 9A-9B are perspective views of the spacer of the RF antenna assembly of FIG. 6.

Referring now specifically to FIGS. 8A-8E, the assembly of the spacer 24' and coupling thereof to the end 35*a*' of the first RF transmission line segment 17*a*' is now described. Initially, the first tubular conductor 15*a*' is positioned in the wellbore of the subterranean formation 17'. As shown, the first RF transmission line segment 17*a*' extends from the end 21*a*' of the first tubular conductor 15*a*'. The RF antenna assembly 19' illustratively includes a dust cap 70' installed over the end 35*a*' of the first RF transmission line segment 17*a*'. Next, the spacer 24' is positioned over the coaxial ends 35*a*', 21*a*' of the first RF transmission line segment 17*a*' and the first tubular conductor 15*a*'. Helpfully, the arms 72*a*'-72*b*' of the spacer 24' are flexible and can be bent outward (as shown in FIG. 8B with bolded arrows) to better fit the end 35*a*' of the first RF transmission line segment 17*a*'. Once the spacer 24' has been positioned over the end 21*a*' of the first tubular conductor 15*a*', the circumferential keys are aligned with the keyed recesses of the first tubular conductor 15*a*', thereby locking/seating the spacer to the first tubular conductor (with a clockwise rotation of about 45 degrees, also shown with bolded arrow in FIG. 8D). The keys and the keyed recesses include a hard stop to readily indicate full seating of the spacer 24'.

Once the keys and the keyed recesses have been locked together, the retention strap 73' is applied to the spacer 24' by threading it through the retention strap rings 76*a*'-76*b*'. The retention strap 73' compresses the arms 72*a*'-72*b*' onto the textured surface of the tubular sheath 26' and resting against a circumferential protrusion 75' (FIG. 7), thereby hanging the first RF transmission line segment 17*a*' onto the first tubular conductor 15*a*'. In other words, the first transmission line segment 17*a*' rests on the first tubular conductor 15*a*' via the circumferential protrusion 75', the arms 72*a*'-72*b*', and the ring portion 71'. If during assembly, the first RF transmission line segment 17*a*' unexpectedly extends from the end 21*a*' of the first tubular conductor 15*a*' an amount to exceeds the reach of the arms 72*a*'-72*b*' to the textured surface of the tubular sheath 26', a reset drill pipe coupler may be used.

Other features relating to RF antenna assemblies are disclosed in co-pending applications: titled "RF ANTENNA ASSEMBLY WITH FEED STRUCTURE HAVING DIELECTRIC TUBE AND RELATED METHODS," U.S. application Ser. No. 13/804,415, titled "RF ANTENNA ASSEMBLY WITH DIELECTRIC ISOLATOR AND RELATED METHODS," U.S. application Ser. No. 13/804,119; and titled "RF ANTENNA ASSEMBLY WITH SERIES DIPOLE ANTENNAS AND COUPLING STRUCTURE AND RELATED METHODS," U.S. application Ser. No. 13/803,927, all incorporated herein by reference in their entirety.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A radio frequency (RF) antenna assembly configured to be positioned within a wellbore in a subterranean formation for hydrocarbon resource recovery, the RF antenna assembly comprising:

first and second tubular conductors to be positioned within the wellbore, and having adjacent joined together ends;

first and second RF transmission line segments extending within said first and second tubular conductors and having adjacent joined together ends aligned with the joined together adjacent ends of said first and second tubular conductors;

a tubular sheath surrounding said first RF transmission line segment and having an outer surface; and a spacer received on the outer surface of said tubular sheath and extending between said tubular sheath and adjacent portions of said first tubular conductor.

2. The RF antenna assembly of claim 1 wherein said outer surface comprises a threaded outer surface; and wherein said spacer is threadingly received on the threaded outer surface of said tubular sheath.

3. The RF antenna assembly of claim 2 wherein said spacer has a plurality of spaced apart passageways therein for permitting fluid flow therethrough.

4. The RF antenna assembly of claim 2 wherein said first tubular conductor has a recess at an end thereof for defining a shoulder receiving said spacer.

5. The RF antenna assembly of claim 4 wherein said second tubular conductor has an end threadingly engaging an end of said first tubular conductor and urging said spacer into the shoulder.

6. The RF antenna assembly of claim 1 wherein said spacer comprises a ring portion, and a plurality of arms extending longitudinally from said ring portion.

7. The RF antenna assembly of claim 6 further comprising a retention strap coupling said plurality of arms onto the outer surface of said tubular sheath.

8. The RF antenna assembly of claim 6 wherein said first tubular conductor has a plurality of keyed recesses at an end thereof for receiving said ring portion.

9. The RF antenna assembly of claim 1 wherein said spacer comprises a dielectric material.

10. The RF antenna assembly of claim 1 wherein said tubular sheath comprises a dielectric material.

11. The RF antenna assembly of claim 1 wherein each of said first and second RF transmission line segments comprises an inner conductor and an outer conductor surrounding said inner conductor.

12. The RF antenna assembly of claim 1 wherein said first RF transmission line segment extends outwardly from an adjacent end of said first tubular conductor.

13. The RF antenna assembly of claim 1 wherein said tubular sheath longitudinally extends from said spacer to the adjacent joined together ends of said first and second RF transmission line segments.

14. A radio frequency (RF) antenna assembly configured to be positioned within a wellbore in a subterranean formation for hydrocarbon resource recovery, the RF antenna assembly comprising:

first and second tubular conductors to be positioned within the wellbore, and having adjacent joined together ends;

first and second RF transmission line segments extending within said first and second tubular conductors and having adjacent joined together ends aligned with the joined together adjacent ends of said first and second tubular conductors;

a dielectric tubular sheath surrounding said first RF transmission line segment and having a threaded outer surface; and a dielectric spacer threadingly received on the threaded outer surface of said dielectric tubular sheath and extending between said tubular sheath and adjacent portions of said first tubular conductor, said spacer having a plurality of spaced apart passageways therein for permitting fluid flow therethrough.

15. The RF antenna assembly of claim 14 wherein said first tubular conductor has a recess at an end thereof for defining a shoulder receiving said dielectric spacer.

16. The RF antenna assembly of claim 15 wherein said second tubular conductor has an end threadingly engaging an end of said first tubular conductor and urging said dielectric spacer into the shoulder.

17. The RF antenna assembly of claim 14 wherein each of said first and second RF transmission line segments comprises an inner conductor and an outer conductor surrounding said inner conductor.

18. The RF antenna assembly of claim 14 wherein said first RF transmission line segment extends outwardly from an adjacent end of said first tubular conductor.

19. The RF antenna assembly of claim 14 wherein said, dielectric tubular sheath longitudinally extends from said dielectric spacer to the adjacent joined together ends of said first and second RF transmission line segments.

20. A method of making a radio frequency (RF) antenna assembly to be positioned within a wellbore in a subterranean formation for hydrocarbon resource recovery, the method comprising:

positioning a first tubular conductor and a first RF transmission line segment within the wellbore, the first RF transmission line segment being within the first tubular conductor and having an end extending outward from the wellbore and past an end of the first tubular conductor;

engaging a spacer onto an outer surface of a tubular sheath surrounding the first RF transmission line segment so that the spacer extends between the tubular sheath and adjacent portions of the first tubular conductor;

threadingly engaging an end of a second RF transmission line segment, exposed from an end of a second tubular conductor, onto the end of the first RF transmission line segment extending past the end of the first tubular conductor; and sliding the second tubular conductor down the second RF transmission line segment and threadingly engaging the second tubular conductor onto the first tubular conductor.

21. The method of claim 20 wherein the engaging of the spacer comprises threadingly engaging the spacer onto a threaded outer surface of the tubular sheath surrounding the first RF transmission line segment.

22. The method of claim 21 further comprising forming the spacer to have a plurality of spaced apart passageways therein for permitting fluid flow therethrough.

23. The method of claim 21 wherein the threadingly engaging of the second tubular conductor onto the first tubular conductor comprises urging the spacer into a shoulder in the end of the first tubular conductor.

24. The method of claim 20 wherein the spacer comprises a ring portion, and a plurality of arms extending longitudinally from the ring portion.

25. The method of claim 24 wherein the engaging of the spacer comprises coupling the spacer onto an outer surface of the tubular sheath with a retention strap surrounding the plurality of arms.

26. The method of claim 24 wherein the engaging of the spacer comprises coupling the ring portion to a plurality of keyed recesses at an end of the first tubular conductor.

* * * * *